US006012461A

United States Patent [19]

McKew

[11] Patent Number: 6,012,461

[45] Date of Patent: Jan. 11, 2000

[54] SCULPTURED FINGERNAIL TRAINING SYSTEMS

[76] Inventor: Linda C. McKew, 622 West Augusta, Phoenix, Ariz. 85021

[21] Appl. No.: 09/243,264

[22] Filed: Feb. 3, 1999

[51] Int. Cl.[7] ..... A45D 29/00

[52] U.S. Cl. ..... 132/73; 132/285; 132/200; 434/100

[58] Field of Search ..... 132/73, 320, 285, 132/200, 73.5, 75, 75.6, 76.5; 434/98, 99, 100, 219

[56] References Cited

U.S. PATENT DOCUMENTS

| | | | |
|---|---|---|---|
| D. 87,660 | 8/1932 | Breeke | 434/100 |
| 2,017,538 | 10/1935 | Kaparin | 434/100 |
| 2,223,842 | 12/1940 | Brekke | 434/100 |
| 4,361,160 | 11/1982 | Bryce | 132/73 |
| 4,643,208 | 2/1987 | Amour | 132/73 |
| 4,682,612 | 7/1987 | Giuliano | 132/73 |
| 4,690,369 | 9/1987 | Giuliano | 132/73 |
| 4,924,889 | 5/1990 | Schaeffer et al. | 132/73 |
| 5,482,057 | 1/1996 | Bushmaker | 132/73 |
| 5,613,507 | 3/1997 | Geer et al. | 132/285 |
| 5,848,597 | 12/1998 | Carpenter | 132/73 |

*Primary Examiner*—Gene Mancene
*Assistant Examiner*—Pedro Philogene
*Attorney, Agent, or Firm*—Martin L. Stoneman

[57] ABSTRACT

A fingernail sculpting teaching system for use in practicing the creation of an artificial fingernail on a typical human finger. The teaching system includes a cylinder for simulating a typical human finger. Formed at each end of the cylinder is a visual marker, shaped to simulate a typical human nail bed, on which is placed the material comprising the artificial fingernail bed. A form may be provided adjacent the visual marker for receiving the material comprising the artificial fingernail free edge. The cylinder may be provided with a cover to faciliate removal of the artificial fingernail from the cylinder.

23 Claims, 3 Drawing Sheets

FIG. 1
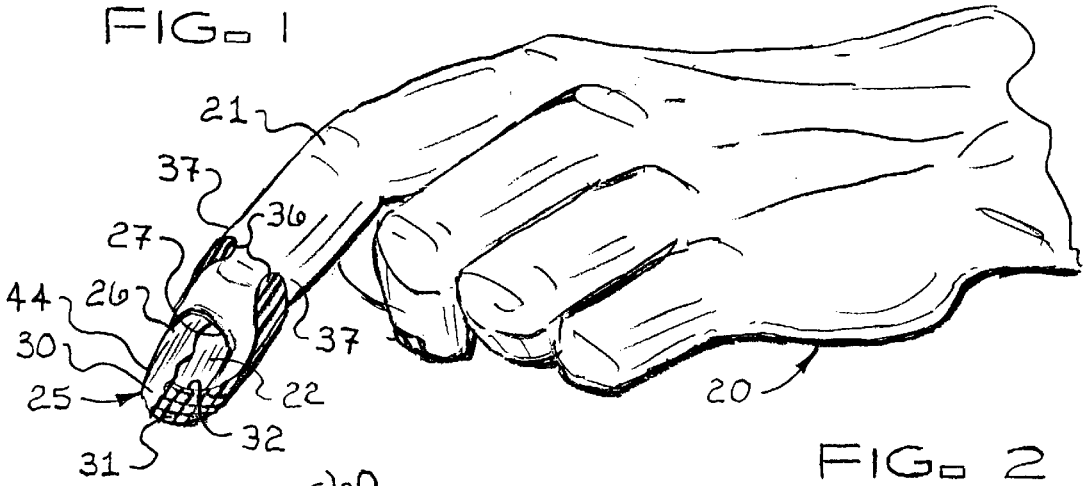
FIG. 2
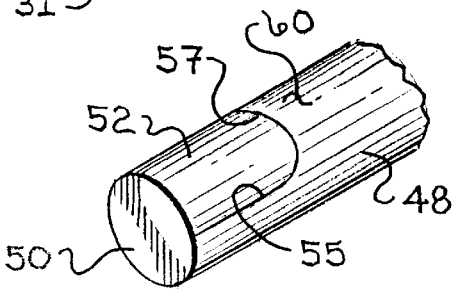
FIG. 3
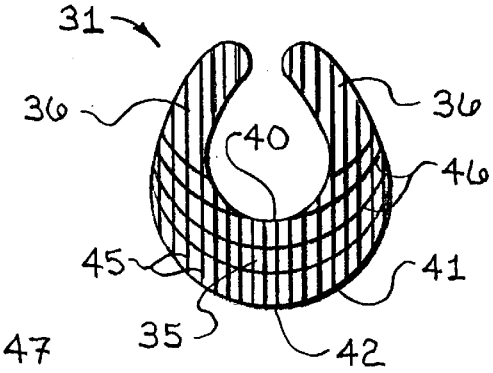
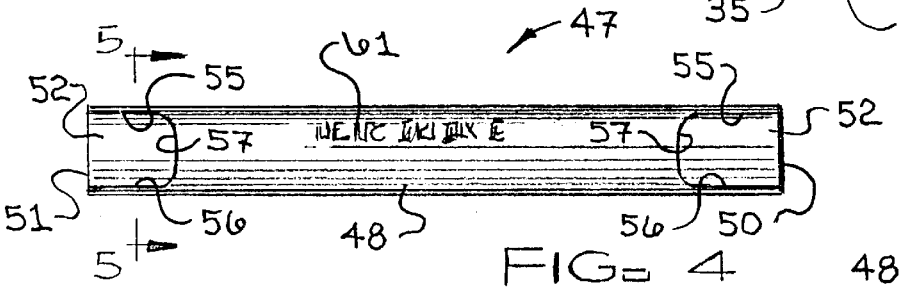
FIG. 4
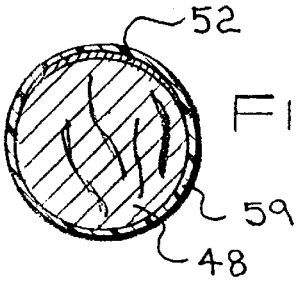
FIG. 5
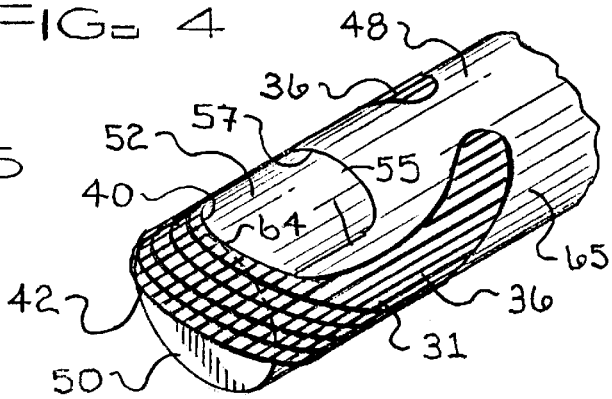
FIG. 6
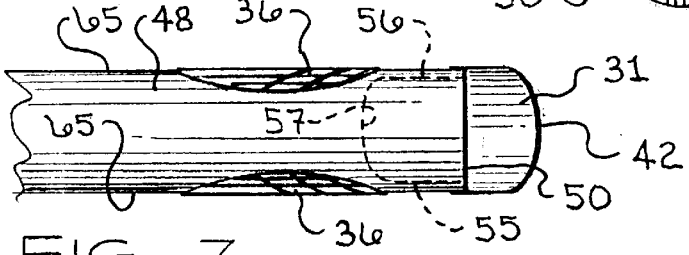
FIG. 7

SCULPTURED FINGERNAIL TRAINING SYSTEMS

BACKGROUND OF THE INVENTION

1. Field of the Invention

This invention relates to providing sculptured fingernail training systems. More particularly, this invention concerns a fingernail sculpting apparatus for use in providing a training device to allow those individuals with a desire to create sculptured fingernails to practice their technique on a simulated human finger.

2. Description of the Prior Art

Typically, learning to create sculptured nails usually requires a coordinated effort between two people—the person creating the sculptured nail and the person volunteering his or her finger to allow the first person to practice. For those institutions such as beauty schools or the like which strive to maximize quality training time, requiring the use of two students in order to allow one to practice results in an inefficient time management problem. Furthermore, the average consumer who desires to learn how to create sculptured artificial fingernails may not have access to a second person who would be willing to lend himself or herself as a practice subject.

Though there exists a multitude of artificial fingernail types including a variety of methods of applying the same, applicant is unaware of any prior art which addresses the aforementioned problems by providing a training apparatus for use in practicing the technique associated with creating sculptured artificial fingernails.

OBJECTS OF THE INVENTION

A primary object of the present invention is to fulfill the above-mentioned needs by the provision of a fingernail sculpting training system. A further primary object of the present invention is to provide such a system which is efficient, easy to use, inexpensive, and easy to manufacture. Other objects of this invention will become apparent with reference to the following invention descriptions.

SUMMARY OF THE INVENTION

According to a preferred embodiment of the present invention, this invention provides a fingernail sculpting teaching system for use in practicing the creation of an artificial fingernail on a typical human finger having a typical fingernail bed, wherein such artificial fingernail is of the type typically comprising an artificial fingernail bed material and artificial fingernail free edge material, such system comprising, in combination: a bar means, having an outer surface, for simulating such human finger; and a marker means, formed on such bar means, for assisting practice receiving of such artificial fingernail bed material, such marker means structured and arranged to simulate such typical fingernail bed.

In addition, this invention provides such a nail sculpting system wherein such bar means comprises a cylinder having a first end and a second end; and, wherein such marker means comprises a visual marker formed adjacent to at least one of such first end and second end, such visual marker having an inner end and a first side edge separated by a distance from a second side edge. This invention further provides such a nail sculpting system further comprising: cover means, attached to such outer surface of such bar means and structured and arranged to cover at least such marker means, for providing a non-stick surface for creating such artificial nail on such bar means; and first attachment means for attaching such cover means to such bar means. And, it further provides such a nail sculpting system wherein such cover means comprises a thin, smooth, and essentially non-porous material; and, further, wherein such cover means has a thickness of about 0.002 inches; and, yet further, wherein such attachment means comprises an adhesive.

Additionally, it provides such a nail sculpting system further comprising a form means, adjacent such marker means, for assisting practicing typical providing of such bar means with such artificial nail free edge material; also, it provides such a system wherein such form means comprises a variable guide means for creating such artificial nail free edge in user-selected sizes. And, this invention provides such a nail sculpting system wherein such bar means comprises a cylinder having a first end and a second end. In addition, this invention provides such a nail sculpting system wherein such marker means comprises a visual marker formed adjacent to at least one of such first end and second end, such visual marker having an inner end, an outer end, and a first side edge separated by a distance from a second side edge.

Yet additionally still, this invention provides for such a nail sculpting system wherein such form means comprises a form having a central portion structured and arranged for location substantially between such outer end and at least one of such first end and second end, such central portion being further structured and arranged to substantially span a second distance at least equal to such distance between such first side edge and such second side edge. And, still further, this invention provides such a nail sculpting system further comprising: cover means, attached to such outer surface of such bar means and structured and arranged to cover at least such marker means and such form means, for providing a non-stick surface for creating such artificial nail on such bar means; and first attachment means for attaching such cover means to such bar means. Yet further, it provides such a nail sculpting system wherein such cover means comprises a thin, smooth, and essentially non-porous material; and, wherein such cover means has a thickness of about 0.002 inches. Also, it provides such a nail sculpting system wherein such attachment means comprises an adhesive.

Even further, in accordance with a preferred embodiment thereof, this invention provides for a fingernail sculpting teaching system for use in practicing the creation of an artificial fingernail on a typical human finger having a typical fingernail bed, wherein such artificial fingernail is of the type typically comprising an artificial fingernail bed material and artificial fingernail free edge material, such system comprising, in combination: a wood cylinder having an outer surface and having a first end and a second end; a visual marker, formed adjacent to at least one of such first end and second end, structured and arranged to receive such artificial fingernail bed material, such visual marker comprising: a inner end, an outer end, a first side edge, and a second side edge separated by a distance from such first side edge; and a plastic sheet attached to such outer surface of such cylinder so as to at least cover such first marker; and an adhesive for attaching such plastic sheet to such cylinder. And, further, it provides such a nail sculpting system wherein such form means comprises a form having a central portion structured and arranged for location substantially between such outer end and at least one of such first end and second end, such central portion being further structured and arranged to substantially span a second distance at least equal to such distance between such first side edge and such second side edge. Also, it provides such a nail sculpting system wherein such plastic sheet is structured and arranged to substantially cover such visual marker and such form.

Yet further still, in accordance with a preferred embodiment thereof, this invention provides for a fingernail sculpting teaching system for use in practicing the creation of an artificial fingernail on a typical human finger having a typical fingernail bed, wherein such artificial fingernail is of the type typically comprising an artificial fingernail bed material and artificial fingernail free edge material, such system comprising the steps of: providing a cylinder comprising: an end, a visual marker formed adjacent to such end; providing a form adjacent to such visual marker; providing such artificial fingernail bed material to such visual marker; providing such artificial fingernail free edge material to such visual form; and allowing a sufficient time for such artificial fingernail bed material and such artificial fingernail bed material to harden; whereby a unitary artificial nail is created on such cylinder.

Additionally, the present invention provides for such a method comprising the subsequent steps consisting of at least one of the following: filing such artificial nail; shaping such artificial nail; and painting such artificial nail. And it provides for such a method comprising the subsequent step of removing such form and such unitary artificial nail from such cylinder, whereby such cylinder is ready for creating a separate artificial fingernail.

BRIEF DESCRIPTION OF THE DRAWINGS

FIG. 1 is a perspective view of a typical human hand illustrating the creation of an artificial sculptured fingernail onto an existing fingernail.

FIG. 2 is a plan view of a preferred form for use with all embodiments of the present invention.

FIG. 3 is a plan view of a preferred embodiment of the present invention specifically illustrating the visual marker.

FIG. 4 is a top view of a preferred embodiment of the present invention.

FIG. 5 is a cross-sectional view, taken from section 5—5 of FIG. 4, illustrating the various layers comprising the preferred embodiment of the present invention.

FIG. 6 is a perspective view of the preferred embodiment of FIG. 4 illustrating the location of the form.

FIG. 7 is a bottom view of the preferred embodiment of FIG. 4 further illustrating the location of the form.

DETAILED DESCRIPTION OF A PREFERRED EMBODIMENT AND THE BEST MODE OF PRACTICE

Figure 8:
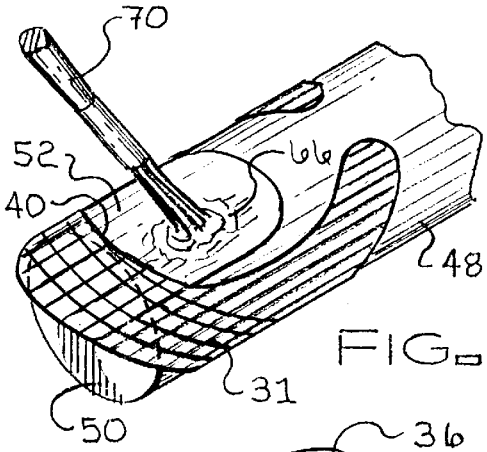
FIG. 8 is a perspective view illustrating the step of applying the artificial fingernail bed material to the marker.

Referring now to the Figures, shown in perspective in FIG. 1 is a typical human hand 20 including at least one typical human finger 21 having an existing fingernail 22 on which is being created a sculptured artificial fingernail 25. As will be disclosed more fully as this disclosure progresses, a sculptured artificial fingernail 25 typically comprise an artificial fingernail bed portion 26 (hereinafter bed portion 26) which is attached to that portion of the existing fingernail overlying the fingernail bed 27, and an artificial fingernail free edge portion 30 (hereinafter free edge portion 30) which, with reference to a typical human fingernail 22, comprises the whitish nail portion of the fingernail 22 which is not directly attached to the fingernail bed 27. Also shown is a form 31 which is used in creating a stylish free edge portion 30. As will be discussed more fully in the disclosure accompanying FIG. 2, that portion of the form 31 which is used to create the free edge portion 30 is typically placed adjacent the distal end 32 of that portion of the existing fingernail 22 overlying the fingernail bed 27.

With reference now to FIG. 2, a typical form 31 used to create a free edge portion 30 is shown. The form 31 illustrated and described herein preferably comprises a paper material having a foil-type coating and is of the type commonly referred to as a "Horseshoe Form" commercially available from International Nail Mfg. (Anaheim, Calif.). Referring further to FIG. 2, the form 31 further comprises a central portion 35 bounded by two opposing leg portions 36 which are structured and arranged for attachment substantially along the side portions 37 of finger 21. The central portion 35, in turn, comprises an inner concave edge 40 and an outer convex edge 41 having an apex 42. As shown best in FIG. 1, the central portion 35 is structured and arranged for placement adjacent the existing fingernail 22 such that the inner concave edge 40 is placed under the existing free edge portion (not shown) adjacent the intersection of the existing fingernail 22 and the fingernail bed 27. To ensure that the artificial fingernail 25 is symmetric with respect to the finger 21, it is recommended that apex 42 be substantially aligned with the center of the existing fingernail 22 prior to attachment. To assist in attaching the form 31 to both the existing finger 21 and fingernail 22, the form 31 described herein is typically provided with an adhesively coated bottom surface 43 (as shown best in FIG. 11). To assist the user in creating a free edge portion 30 having substantially planar side edges 44 (as shown best in FIG. 1), the form 31 described herein is also provided with substantially longitudinal guide lines 45. Also provided are curved guide lines 46 (embodying herein a variable guide means for creating such artificial nail free edge in user-selected sizes) for assisting the user in creating a free edge 30 of variable lengths.

Shown in FIGS. 3 and 4 are, respectively, a partial perspective view and plan view of a preferred embodiment of the artificial fingernail sculpting system hereinafter referred to as sculpting system 47. As will become apparent to those skilled in such art as this disclosure progresses, all embodiments of the present invention disclosed herein provide a useful and efficient practice piece for those desiring to create sculptured artificial fingernails 25 without the need for having a human subject to practice on. The sculpting system 47 of the present invention comprises an elongated cylinder 48, preferably comprising a wooden material, and having a first end 50 and a second end 51. To simulate the approximate size of a typical human finger 21, the cylinder 48 is substantially elongated in shape and has a preferred diameter of approximately ½-inch and a preferred length of approximately 3¾-inch. The cylinder 48 embodies herein a bar means, having an outer surface, for simulating such human finger. Though the preferred material comprising cylinder 48 is as previously disclosed, it is to be understood that the cylinder 48 may consist of any suitably rigid material such as, e.g., plastic, ceramic, glass, etc.

To provide a representation of a typical nail bed 27, a visual marker 52 is provided at preferably both the first end 50 and second end 51, as shown in FIG. 4. Each visual marker 52 comprises a first side edge 55, a second side edge 56, and an inner end 57 and is preferably created by the use of acrylic-type paints (preferably having a pinkish hue). In the present embodiment, it is preferred that each visual marker 52 be structured and arranged to extend for a distance of approximately 9/16-inch from each respective end 50 and 51 to each inner end 57. Each visual marker 52 embodies herein a marker means, formed on such bar means, for assisting practice receiving of such artificial fingernail bed material, such marker means structured and arranged to simulate such typical fingernail bed. Though the preferred method of creating each visual marker 52 is as disclosed above, other methods such as ink stamping or impressing a nail bed representation onto the cylinder 48 may be used without deviating from the spirit of the present invention.

Reference should now be made to the fact that once the artificial fingernail 25 is created on the cylinder 48, a means is needed to easily remove the artificial nail 25 from the cylinder 48 without damaging the visual marker 52. To this end, the sculpting system 47 of the present invention is provided with a cover 59 (shown best in FIG. 5), preferably comprising a substantially plastic material, which is attached, preferably with an adhesive, to the outer surface 60 (as shown in FIG. 3) of cylinder 48. To ensure easy removal of the artificial fingernail 25 from the cylinder 48, it is also preferred that the material comprising the cover 59 be substantially non-porous so as to minimize any adhesion of the material comprising the artificial fingernail 25 to the cylinder 48. An example of a suitable preferred cover material is that material preferably made of a polypropylene-type material such as the type commercially available under the name SCOTCH (TM) "Super Strength Mailing Tape" commercially available from the 3M Company (St. Paul, Minn.) and having a preferred thickness of approximately 0.002-inch. Using a material like the one described illustrates the preference herein that the cover means comprise a thin, smooth, and essentially non-porous material. The cover 59 embodies herein cover means, attached to such outer surface of such bar means and structured and arranged to cover at least such marker means, for providing a non-stick surface for creating such artificial nail on such bar means. In addition, the cover 59 described herein is typically provided with an adhesively coated surface (embodying herein a first attachment means for attaching such cover means to such bar means) which can be utilized to facilitate attachment to the cylinder 48. Also shown in FIG. 4 is logo-type identifying indicia 61 which may be either provided directly on the outer surface 60 of cylinder 48 or provided on a sticker (not shown) which is attached to the outer surface 60. FIG. 5 is a cross-sectional view, taken from section 5—5 in FIG. 4, illustrating the arrangement of the above-mentioned sculpting system 47 components.

Shown in FIGS. 6–11 are the preferred sequence of steps to be taken in creating an sculptured artificial fingernail 25 using the preferred sculpting system 47 of the present invention. Shown in FIGS. 6 and 7 is the initial step of attaching form 31 to the cylinder 48. For the purpose of avoiding unnecessary repetition, the method described herein will be described with reference to end 50, though it should be understood that the method disclosed as follows applies equally to creating a artificial fingernail 25 on end 51. Attachment of the form 31 to the cylinder 48 consists of first aligning the apex 42 of form 31 with a point substantially between the first side edge 55 and second side edge 56 of the visual marker 52 and placing the form 31 on the cylinder 48 such that the innermost point (designated generally by reference numeral 64) of the inner concave edge 40 lies over that part of the visual marker 52 immediately adjacent end 50. Upon achieving proper positioning, one presses the remainder of the form 31 onto the contour of the cylinder 48, which results in each respective leg portion 36 being substantially attached to an opposing cylinder side portion 65. As disclosed previously with respect to FIG. 2, the form 31 is typically provided with an adhesively coated bottom surface 43 (shown best in FIG. 11) which is utilized to facilitate attachment to the cylinder 48. As shown in FIG. 7, when properly positioned, the central portion 35 of form 31 extends past the end 50 of cylinder 48. The form 31 embodies herein a form means, adjacent such marker means, for assisting practicing typical providing of such bar means with such artificial nail free edge material.

After the form 31 is properly attached to the cylinder 48 in accordance with the above mentioned procedure, the cylinder 48 is ready to receive the materials comprising the artificial fingernail 25. Shown in FIG. 8 is the step (performed after the step of FIG. 9) of applying the artificial fingernail bed material 66 (hereinafter bed material 66) to that portion of the cover 59 (as shown best in FIG. 5) adjacent the visual marker 52, thereby forming the bed portion 26. For all embodiments described herein, the bed material 66 comprises a well-known mixture of a liquid acrylic monomer and powdered acrylic polymer (preferably having a pinkish hue) both of the type commercially available from Kupa Industries (Buena Park, Calif.). Formation of the bed portion 26 consists of first placing a brush 70, or other suitable device, into the liquid acrylic monomer followed by placing the brush 70 into the powdered acrylic polymer. The resultant bed material 66 mixture contained on brush 70 is applied to that portion of the cover 59 overlying the visual marker 52 in a quantity sufficient to cover the visual marker 52 up to the inner concave edge 40 of form 31.

Figure 9:
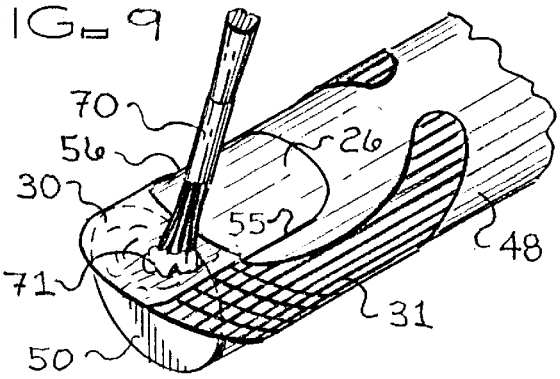
FIG. 9 is a perspective view illustrating the step of applying the artificial fingernail free edge material to the form.

Shown in perspective in FIG. 9 is the prior step of creating the free edge portion 30. The free edge portion 30 consists of artificial fingernail free edge material 71 (hereinafter free edge material 71) preferably comprising a mixture of a liquid acrylic monomer preferably of the type previously disclosed, and a powdered acrylic polymer, preferably having a whitish hue, of the type also commercially available from Kupa Incorporated. Formation of the free edge portion 30 consists of first placing a brush 70, or other suitable device, into the liquid acrylic monomer followed by placing the brush 70 into the powdered acrylic polymer. Next, the free edge material 71 mixture contained on brush 70 is applied onto that central portion 35 (as shown best in FIG. 2) of form 31 spanning a second distance being approximately equal to, and substantially aligned with, the distance between the first side edge 55 and second side edge 56. It is recommended that there be a minor overlap of the bed material 66 over the free edge material 71 in order to bind the two materials so as to create a unitary artificial fingernail 25 of uniform strength and thickness. The method described herein embodies a method comprising the steps of: providing a cylinder comprising an end, a visual marker formed adjacent to such end; providing a form adjacent to such visual marker; providing such artificial fingernail free edge material to such form; providing such artificial fingernail bed material to such visual marker; and allowing a sufficient time for such artificial fingernail bed material and such artificial fingernail bed material to harden; whereby a unitary artificial nail is created on such cylinder.

Figure 11:
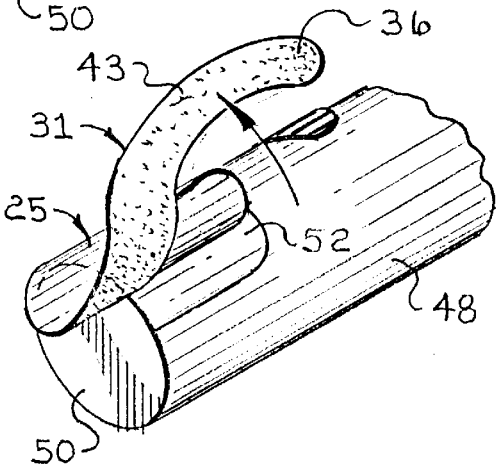
FIG. 11 is a perspective view illustrating the final step of removing the form and artificial fingernail from the preferred sculptured fingernail training system embodiment.
Figure 10:
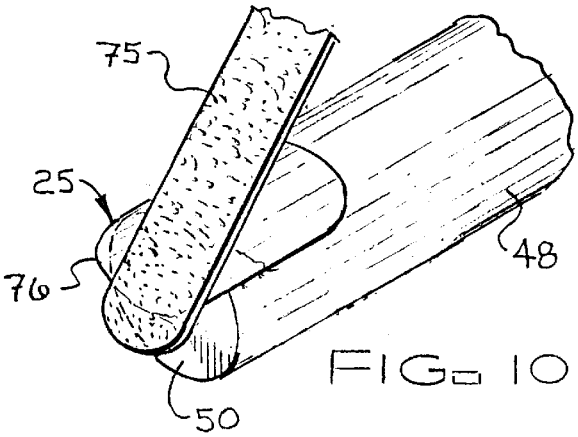
FIG. 10 is a perspective view illustrating a subsequent step of filing the artificial fingernail.

Shown in FIG. 10 is an example of a finishing step which is often performed, upon allowing a sufficient time for the artificial fingernail 25 to harden, after creating a sculptured artificial nail 25 on a human finger 21. Shown specifically is the step (after removing form 31) of using a typical fingernail file 75 to smooth and shape the exposed outer perimeter 76 of the artificial fingernail 25. Other finishing steps which may be performed while the artificial fingernail is attached to the cylinder 48 include, but are not limited to, painting and shaping the artificial fingernail 25. FIG. 11 illustrates the step of removing the form 31 from the cylinder 48. Removal of this item consists of simply grasping a leg portion 36 and peeling the form 31, leaving the artificial fingernail 25 attached, off the cylinder 48. Once removed, the cylinder 48 is immediately ready to be a practice piece for creating another artificial fingernail 25.

Figure 12:
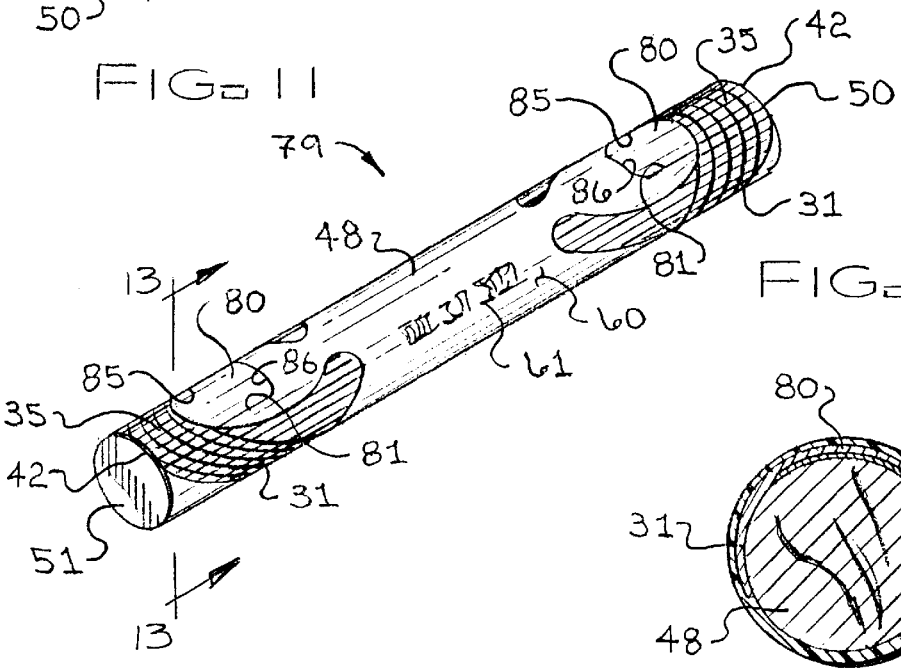
FIG. 12 is a perspective view of an alternate preferred embodiment of the sculptured fingernail training system.
Figure 13:
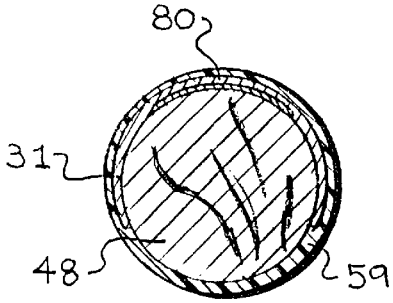
FIG. 13 is a cross-sectional view, taken from section 13—13 in FIG. 12, illustrating the various layers comprising the alternate preferred embodiment.
Figure 14:
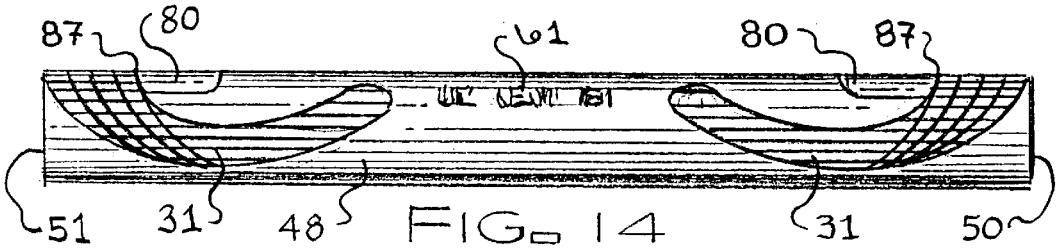
FIG. 14 is a left side view of the alternate preferred embodiment of FIG. 12.

Shown in FIGS. 12–14 is an alternate preferred embodiment of the nail sculpting system hereinafter referred to as sculpting system 79. As will soon become apparent to those skilled in such art, the alternate preferred embodiment described herein is most useful in providing the initial nail sculpting training step of first learning how to use the various materials (described previously with respect to FIGS. 8 and 9) comprising an artificial fingernail 25 which is a necessary antecedent step to learning how to attach the form 31 to the cylinder 48. The sculpting system 79 comprises a cylinder 48 as substantially illustrated and described previously with respect to the aforementioned preferred embodiment. Formed adjacent each end 50 and 51 is a visual marker 80, also preferably created by the use of acrylic-type paints (preferably having a pinkish hue), and having a first side edge 81, a second side edge 85 and having an inner end 86. Attached adjacent to each respective end 50 and 51 is a form 31, preferably of the type hereinbefore illustrated and described with respect to FIG. 2.

As shown best in FIG. 12, the central portion 35 of each form 31 is structured and arranged for placement over a portion of each visual marker 80 such that the apex 42 lies immediately adjacent each end 50 and 51. To ensure that the artificial fingernail 25 is symmetric with respect to the cylinder 48, it is recommended that apex 42 be substantially aligned with the center of the visual marker 80 prior to attachment. In order to fully accommodate the central portion 35 of form 31 while providing sufficient visual marker 80 exposure so as to simulate the approximate size of a typical human fingernail bed 27, it is preferred that each visual marker 80 extend from each respective end 50 and 51 to each inner end 86 for a distance of approximately 1-inch. It is to be understood that even though the preferred size and arrangement of the visual marker 80 is as described above, other arrangements may also be used without deviating from the spirit of the present invention. Such other arrangements include, but are not limited to, providing the visual marker 80 with an outer end 87 (as shown in FIG. 14) which is structured and arranged to closely abut the inner concave edge 40 of form 31 when the form 31 is attached onto the cylinder 48 in accordance with the above disclosed procedure. FIG. 13 is a cross-sectional view, taken from section 13—13 in FIG. 12, illustrating the arrangement of the various components comprising the sculpting system 79. As shown in FIG. 13, the sculpting system 79 may also comprise a cover 59, preferably of the type fully disclosed previously with respect to FIG. 5, which is structured and arranged to completely overlay the cylinder 48, each visual marker 80, and each form 31. As used in the present embodiment, the cover 59 embodies herein a cover means, attached to such outer surface of such bar means and structured and arranged to cover at least such marker means and such form means, for providing a non-stick surface for creating such artificial nail on such bar means. As further shown in FIG. 12, the cylinder 48 may be provided with logo-type identifying indicia 61 which may be either provided directly on the outer surface 60 of cylinder 48 or provided on a sticker (not shown) which is attached to the outer surface 60.

Figure 16:
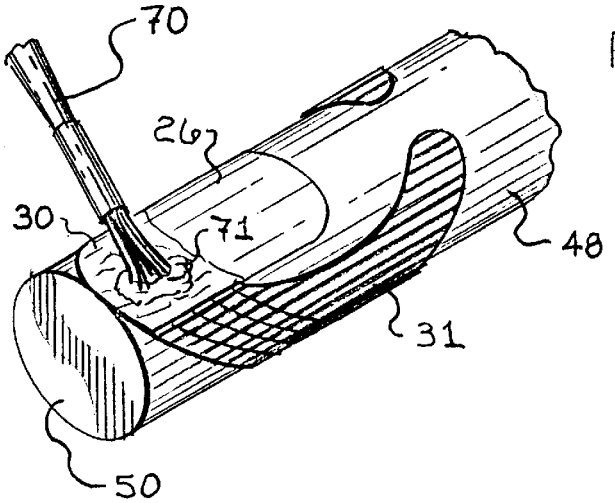
FIG. 16 is a perspective view of the alternate preferred embodiment of FIG. 12 illustrating the step of applying the artificial fingernail free edge material to the form.
Figure 15:
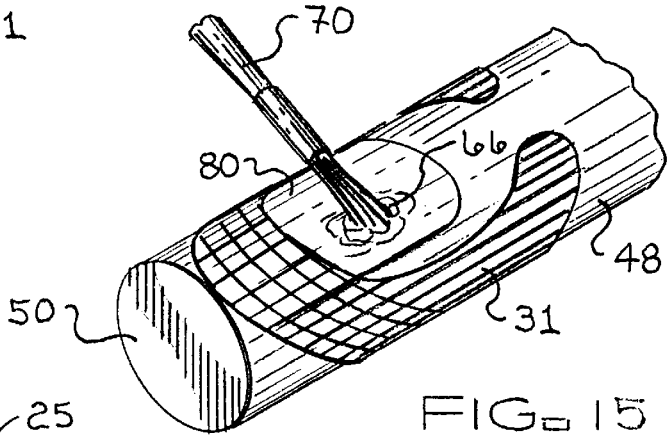
FIG. 15 is a perspective view of the alternate preferred embodiment of FIG. 12 illustrating the step of applying the artificial fingernail bed material to the marker.
Figure 17:
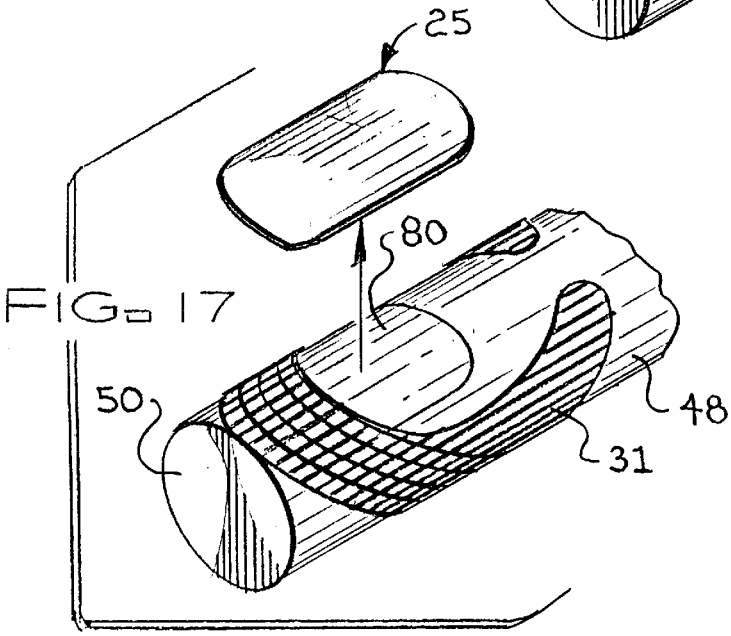
FIG. 17 is an exploded perspective view of the alternate preferred embodiment of FIG. 12 illustrating the final step of removing the artificial fingernail from the alternate preferred sculptured fingernail training system embodiment.

Shown in FIGS. 15–17 are the preferred sequence of steps to be taken in creating an sculptured artificial fingernail 25 using the alternate preferred sculpting system 79 of the present invention. Shown in FIGS. 15 and 16 are the steps to be performed in creating, respectively, the bed portion 26 and free edge portion 30 of the artificial fingernail 25, both of which are created in the present embodiment in the manner as fully illustrated and described previously with respect to FIGS. 8 and 9. After allowing a sufficient amount of time for the artificial fingernail 25 to harden, the artificial fingernail 25 is removed from the cylinder 48 as shown in an exploded perspective view in FIG. 17. Once removed, the cylinder 48 is immediately ready to be a practice piece for creating another artificial fingernail 25.

Although applicant has described applicant's preferred embodiments of this invention, it will be understood that the broadest scope of this invention includes such modifications as diverse shapes, sizes and materials. Such scope is limited only by the below claims as read in connection with the above specification. Further, many other advantages of applicant's invention will be apparent to those skilled in the art from the above descriptions and the below claims.

What is claimed is:

1. A fingernail sculpting teaching system for use in practicing the creation of an artificial fingernail on a typical human finger having a typical fingernail bed, wherein said artificial fingernail is of the type typically comprising an artificial fingernail bed material and artificial fingernail free edge material, said system comprising, in combination:

(a) a bar means, having an outer surface, for simulating said human finger; and (b) a marker means, formed on said bar means, for assisting practice receiving of said artificial fingernail bed material, said marker means structured and arranged to simulate said typical fingernail bed;

(c) wherein said bar means and said marker means are structured and arranged to provide a teaching system for teaching the creation of the artificial fingernail;

(d) wherein said marker means comprises a plurality of substantially exposed edges.

2. The nail sculpting system of claim 1 wherein said bar means comprises a cylinder having a first end and a second end.

3. The nail sculpting system of claim 2 wherein said marker means comprises a visual marker formed adjacent to at least one of said first end and second end, said visual marker having an inner end and a first side edge separated by a distance from a second side edge.

4. The nail sculpting system of claim 1 further comprising a form means, adjacent said marker means, for assisting practicing typical providing of said bar means with said artificial nail free edge material.

5. The nail sculpting system of claim 4 wherein said form means comprises a variable guide means for creating said artificial nail free edge in user-selected sizes.

6. The nail sculpting system of claim 4 wherein said bar means comprises a cylinder having a first end and a second end.

7. The nail sculpting system of claim 6 wherein said marker means comprises a visual marker formed adjacent to at least one of said first end and second end, said visual marker having an inner end, an outer end, and a first side edge separated by a distance from a second side edge, and said outer end being located on said cylinder a distance from a said end of said cylinder.

8. The nail sculpting system of claim 7 wherein said form means comprises a form having a central portion structured and arranged for location substantially between said outer end and at least one of said first end and second end, said central portion being further structured and arranged to substantially span a second distance at least equal to said distance between said first side edge and said second side edge.

9. A fingernail sculpting teaching system for use in practicing the creation of an artificial fingernail on a typical human finger having a typical fingernail bed, wherein said artificial fingernail is of the type typically comprising an artificial fingernail bed material and artificial fingernail free edge material, said system comprising, in combination:

(a) a bar means, having an outer surface, for simulating said human finger; and (b) a marker means, formed on said bar means, for assisting practice receiving of said artificial fingernail bed material, said marker means structured and arranged to simulate said typical fingernail bed;

(c) a cover means, attached to said outer surface of said bar means and structured and arranged to cover at least said marker means, for providing a non-stick surface for creating said artificial nail on said bar means; and (d) a first attachment means for attaching said cover means to said bar means.

10. The nail sculpting system of claim 9 wherein said cover means comprises a thin, smooth, and essentially non-porous material.

11. The nail sculpting system of claim 10 wherein said cover means has a thickness of about 0.002 inches.

12. The nail sculpting system of claim 9 wherein said attachment means comprises an adhesive.

13. A fingernail sculpting teaching system for use in practicing the creation of an artificial fingernail on a typical human finger having a typical fingernail bed, wherein said artificial fingernail is of the type typically comprising an artificial fingernail bed material and artificial fingernail free edge material, said system comprising, in combination:

(a) a bar means, having an outer surface, for simulating said human finger; and (b) a marker means, formed on said bar means, for assisting practice receiving of said artificial fingernail bed material, said marker means structured and arranged to simulate said typical fingernail bed;

(c) a form means, adjacent said marker means, for assisting practicing typical providing of said bar means with said artificial nail free edge material;

(d) a cover means, attached to said outer surface of said bar means and structured and arranged to cover at least said marker means and said form means, for providing a non-stick surface for creating said artificial nail on said bar means; and (e) a first attachment means for attaching said cover means to said bar means.

14. The nail sculpting system of claim 13 wherein said cover means comprises a thin, smooth, and essentially non-porous material.

15. The nail sculpting system of claim 14 wherein said cover means has a thickness of about 0.002 inches.

16. The nail sculpting system of claim 13 wherein said attachment means comprises an adhesive.

17. A fingernail sculpting teaching system for use in practicing the creation of an artificial fingernail on a typical human finger having a typical fingernail bed, wherein said artificial fingernail is of the type typically comprising an artificial fingernail bed material and artificial fingernail free edge material, said system comprising, in combination:

(a) a wood cylinder having an outer surface and having a first end and a second end;

(b) a visual marker, formed adjacent to at least one of said first end and second end, structured and arranged to receive said artificial fingernail bed material, said visual marker comprising:

(i) a inner end, (ii) an outer end, (iii) a first side edge, and (iv) a second side edge separated by a distance from said first side edge; and (c) a plastic sheet attached to said outer surface of said cylinder so as to at least cover said first marker; and (d) an adhesive for attaching said plastic sheet to said cylinder.

18. The nail sculpting system of claim 17 further comprising a form having a central portion structured and arranged for location substantially between said outer end and at least one of said first end and second end, said central portion being further structured and arranged to substantially span a second distance at least equal to said distance between said first side edge and said second side edge.

19. The nail sculpting system of claim 18 wherein said plastic sheet is structured and arranged to substantially cover said visual marker and said form.

20. A method of making a fingernail sculpting teaching system for use in practicing the creation of an artificial fingernail on a typical human finger having a typical fingernail bed, wherein said artificial fingernail is of the type typically comprising an artificial fingernail bed material and artificial fingernail free edge material, comprising the steps of:

(a) providing a cylinder comprising:

(i) an end, (ii) a visual marker formed adjacent to said end;

(b) providing a form adjacent to said visual marker;

(c) providing said artificial fingernail bed material to said visual marker;

(d) providing said artificial fingernail free edge material to said visual form; and (e) allowing a sufficient time for said artificial fingernail bed material and said artificial fingernail bed material to harden;

(f) whereby a unitary artificial nail is created on said cylinder.

21. The method of claim 20 comprising the subsequent steps consisting of at least one of the following:

(a) filing said artificial nail;

(b) shaping said artificial nail; and (c) painting said artificial nail.

22. The method of claim 21 comprising the steps of removing said form and said unitary artificial nail from said cylinder, whereby said cylinder is ready for creating a separate artificial fingernail.

23. The method of claim 20 comprising the subsequent step of removing said unitary artificial nail from said cylinder, whereby said cylinder is ready for creating a separate artificial fingernail.

* * * * *